United States Patent [19]

Tzincoca

[11] Patent Number: 4,540,150

[45] Date of Patent: Sep. 10, 1985

[54] SELF ELEVATING FORMWORK INSTALLATION WITH VARIABLE GEOMETRY FOR MAKING CONCRETE SURFACES, PARTICULARLY VERY HIGH CONCRETE SURFACES

[75] Inventor: Alexandre Tzincoca, Paris, France

[73] Assignee: Entreprise Generale Industrielle, Noisy-le-Grand, France

[21] Appl. No.: 631,556

[22] PCT Filed: Nov. 9, 1983

[86] PCT No.: PCT/FR83/00222

§ 371 Date: Jul. 6, 1984

§ 102(e) Date: Jul. 6, 1984

[87] PCT Pub. No.: WO84/01977

PCT Pub. Date: May 24, 1984

[30] Foreign Application Priority Data

Sep. 11, 1982 [FR] France ..... 82 18725

[51] Int. Cl.[3] ..... E04G 11/22; E04G 11/28

[52] U.S. Cl. ..... 249/20

[58] Field of Search ..... 249/20

[56] References Cited

U.S. PATENT DOCUMENTS

| | | | |
|---|---|---|---|
| 2,649,643 | 8/1953 | Schutte . | |
| 3,705,776 | 12/1972 | Johansson | 249/20 |
| 4,060,358 | 11/1977 | Fougea | 249/20 |
| 4,166,603 | 9/1979 | Ward | 249/20 |

FOREIGN PATENT DOCUMENTS

| | | | |
|---|---|---|---|
| 2452182 | 5/1976 | Fed. Rep. of Germany . | |
| 2814141 | 10/1978 | Fed. Rep. of Germany | 249/20 |
| 1164919 | 5/1958 | France . | |
| 1325094 | 3/1963 | France . | |
| 1411731 | 8/1965 | France . | |
| 2393127 | 5/1978 | France . | |

*Primary Examiner*—Willard E. Hoag

*Attorney, Agent, or Firm*—Larson and Taylor

[57] ABSTRACT

A self-elevating formwork for making concrete walls. The apparatus includes means for temporarily fixing working platforms to previously cast wall portions and is characterized by upright members having a pivot on one side and elevation adjustment means on the opposite side.

21 Claims, 33 Drawing Figures

SELF ELEVATING FORMWORK INSTALLATION WITH VARIABLE GEOMETRY FOR MAKING CONCRETE SURFACES, PARTICULARLY VERY HIGH CONCRETE SURFACES

The present invention relates to self elevating formwork installations with variable geometry for making concrete walls, in particular walls of great height, these walls being formed by successive lifts of constant height, carried out practically simultaneously, successively or in blocks over the whole length of the work until the desired height is obtained, this installation comprising essentially means for temporarily fixing working platforms over an underlying part of the wall already cast and hardened, means for shuttering the next lift over said underlying part, and elevating means adapted to provide self elevation of the whole of the working platforms.

The aim of the present invention is to provide such an installation which allows thin walls made from self stable reinforced concrete to be erected better and more rapidly than the installations known up to present, and in particular walls of great height with a generally circular cross section and with evolutive geometry, as in the case in particular of high cooling towers in the form of hyperbolids of revolution.

Such an installation will then have to allow the construction of the formwork forming the mold for giving to the wall the desired shape, and it will further have to allow means to be obtained for the support and self elevation of the different scaffoldings giving access to all the parts of the work under construction, and all the necessary operations to be carried out, namely reinforcement, shuttering, concrete work as well as the control of all the moving mechanical parts.

In particular, an installation in accordance with the invention will also have to allow the extremely accurate adjustment of the different slopes of the wall to be formed, by actuating means for adjusting the successive and relative slopes of the different elements of the shutter work.

As for the assemblies of the working platforms, they will have to be also very simply adaptable to the variations of the radius of the curvature of the work under construction, this radius of curvature undergoing extremely large variations from the base to the top of the tower under construction.

All these aims, as well as others which will appear from reading the following description, are attained by means of an installation of the general type defined at the beginning in which, in accordance with the present invention will be essentially characterized in that said fixing means comprise series of main uprights extending substantially in vertical planes, these series being evenly spaced apart along the length of the wall, said main uprights serving essentially, on the one hand, as elements for maintaining in position the forms of the shutter work, and, on the other hand, as means for guiding and securing mobile self elevating brackets supporting said working platforms.

Hereagain, the following description better reveals how the aims sought may be attained with the above generally defined means.

In any case an essential arrangement of the present invention such as defined above and which largely contributes to reaching these aims, resides in the multiple role played by what was designated above by the name "main uprights", these uprights serving on the one hand as evolutive supports for the shutter work elements and on the other hand as guide and securing means for the mobile self elevating brackets, which support the working platforms.

According to an essential complementary arrangement of the present invention, in each series of main uprights it is provided that all uprights, except for the upper upright, are anchored in the cast and hardened concrete of a certain number of preceding lifts.

This arrangement will guarantee an excellent fixing of the series of main uprights on the already hardened concrete, which is essentially for the safety of the personnel, as well as for the accuracy in positioning the shutter work.

The evolutive character of the uprights, namely their ability to be appropriately orientated in the radial direction will result in the complementary arrangement according to which each series of main uprights comprises a number of uprights situated in the same vertical plane, directly superimposed and hinged to each other, and each of which is slanted through a given angle with respect to the adjacent upright.

Thus, besides securing the shutter work, the main uprights allow accurate radial adjustment thereof.

As will be seen further on also, the structure of these main uprights may be in addition such that they may compensate very readily for the tangential contraction of the shutter work panels, besides serving as guide and securing rails for the mobile brackets.

In any case, it is a question here of essential strengthening elements adapted to take up the radial and tangential stresses of the concrete and transmitting to the preceding lift all the stresses which they receive.

An installation according to the present invention may be further characterized in that it comprises in addition transfer means adapted for actuation after casting and to transfer the lower main upright of each of said series of uprights into a position situated above and in the alignment of the main upper upright of the series considered, in which position said transferred upright may then be fixed, with the desired slope with respect to the main upright immediately underneath, by using appropriate adjustment means.

Each main upright, in each series of main uprights, may thus be used a large number of times by passing from a lower position in the series to an upper position in the same series when it is no longer useful at the bottom of the series.

Hereagain, this sequential transfer of the lower uprights to the upper part of the series of uprights will be better understood hereafter.

A more or less large number of main uprights may be provided in each of the above mentioned series, but it will be particularly appropriate, hereagain according to an advantageous complementary arrangement of the present invention, to have four uprights in each of the series of main uprights, each series of uprights then being anchored in the cast and hardened concrete of three precedng lifts, which is sufficient to provide excellent fixing safety.

As for the means for adjusting the slope of a main upright with respect to the adjacent main upright, they may be formed in different ways, but, according to a particularly reliable inmplementation allowing ready adjustment, these adjustment means may comprise, on the one hand, at both ends of said main uprights a first screw spacing adjustment device or similar, opposite a transverse hinging means and, on the other hand, a keying system or similar, adapted to lock two main adjacent uprights with a relative slope once they have been adjusted.

According to another particularly advantageous arrangement of the invention, the installation may be further characterized in that said shutter work means comprise, in cooperation with the upper uprights of said series of main uprights, secondary uprights inserted, on each side of the wall, between two series of main adjacent uprights.

These secondary uprights may cooperate efficiently in securing the shutter work elements, concurrently with the main upper uprights of each series, besides allowing compensations to be made, like these latter, for the tangential contraction of the shutter work panels.

Furthermore, it is apparent that the use of such secondary uprights inserted between the series of main uprights will divide by two the span between two adjacent series of main uprights, without for all that having to double the number of these series.

In addition, it will be advantageous and convenient to fix each secondary upright to the main upper upright which is facing it by means of a set of fixing rods passing through the space provided for the next casting.

Moreover, since said secondary upright may be recovered at each lift, it will be advantageous for each of them to be extended at its lower end by a hinged extension, whose slope with respect to the secondary upright properly speaking is adjustable.

With such an extension, the secondary upright may be fixed to the lower lift after the concrete has set; it will further allow the slope of the secondary upright concerned to be adjusted with respect to this preceding lift; and it will finally allow, if required, to provide a tangential compensation,towards the outside of the wall (convex side) so that the shutter work will be always completed vertically.

Turning to the self elevating mobile brackets which, as was mentioned above, are intended to support the working platforms and which may be guided and secured to said main uprights, in accordance with another advantageous embodiment of the present invention they will be advantageously provided in the form of hinged parallelogram structures, these structures being associated with means for adjusting their deformation, which may be actuated depending on the slope of the part of the wall to be shuttered, these means being adapted to maintain said working platforms constantly horizontal.

Theoretically, each bracket may comprise main front stringers hingedly connected, by means of bearing cross pieces, to secondary rear stringers, said deformation adjustment means being formed by screw or similar adjustment stays extending diagonally between main and secondary stringers.

Said bearing cross pieces may comprise, on the one hand, first cross pieces at the level of landings theoretically indeformable, these landings providing passage from one platform to the adjacent platform at the same level, and second cross pieces supporting the platforms respectively at the same level as said landings, but disposed above the preceding ones.

Considering the above explanations and the number of main uprights in each series, each bracket may comprise three landings, two neighboring brackets consequently supporting three levels of working platforms.

It will be further advantageous for each of said landings to have a communicating trap door, for passing from one level to the adjacent level, more especially for passing main uprights and other equipment from one level to another.

The brackets of an installation in accordance with the invention may be further characterized by the fact that they each comprise on the one hand a fixed arm disk, disposed between the main stringers and adapted to bear against the corresponding main upright and, on the other hand, a mobile motor driven arm, adapted to be guided on the one hand between the main strings of the bracket and, on the other hand, over said corresponding main upright and also to bear, at a given location, on said main upright.

As will be clear from reading what follows, the fixed and mobile arms of each bracket will cooperate so as to subject this latter to self elevation when passing from one lift to the next left.

It may be further advantageous for each bracket to comprise an additional bearing device—roller or similar—which is disposed at its lower part so as to be able to bear directly against the wall.

In any case, the brackets also form essential elements of an installation in accordance with the invention, for supporting the different walk ways and working platforms while maintaining them constantly horizontal, not withstanding the different slopes of the wall during construction, and in addition, while serving as working cages particularly for recovering the lower main upright and repositioning it three lifts higher, they form an automatic climbing system at each new lift.

These brackets will in general support three working levels, namely, from top to bottom, a reinforcing and concrete work level, a shuttering and shuttering removal level and finally a climbing level.

Finally, the platform assemblies will have to fulfill essentially their role of working and passage floor, while adapting themselves exactly and automatically, in so far as their length is concerned to the essentially variable spacings which occur between two adjacent brackets, because of the variable radius of curvature of the concrete wall, when it is a question of a cooling tower in the shape of a hyperboloid.

To this end, it will be advantageous, in accordance with yet another arrangement of the invention, for each platform to have a lower platform chassis and an upper platform chassis, extending between and bearing on two adjacent brackets, these two chassis being free to slide with respect to each other.

For this arrangement, said lower platform chassis may in addition be formed from a frame bearing on a bracket and a beam bearing on the adjacent bracket, said beam being slidingly connected to said frame, and in that said upper platform chassis is mounted for bearing, on the one hand, on the same bracket as said beam and, on the other hand, also slidingly on the lower platform.

One embodiment of the invention will now be described, by way of example which is in no wise limitative, with reference to the Figures of the accompanying drawing in which.

Figure 2:
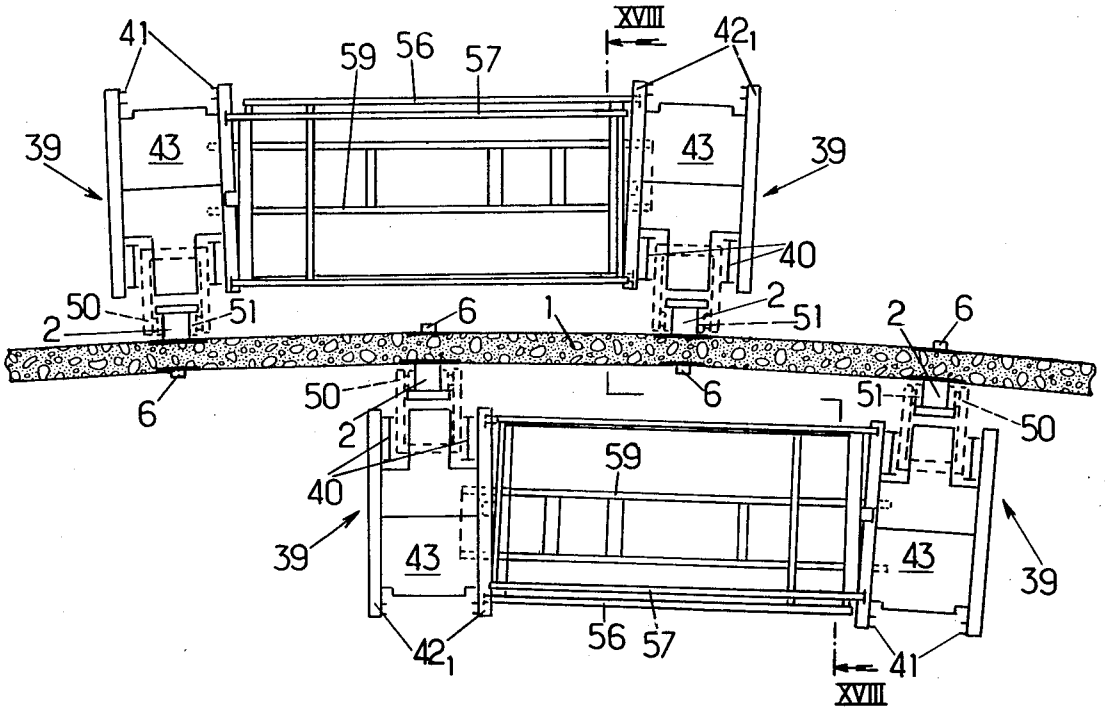
FIG. 2 is a view similar to that of FIG. 1, but in which said platforms are in their position of minimum extension.
Figure 11A:
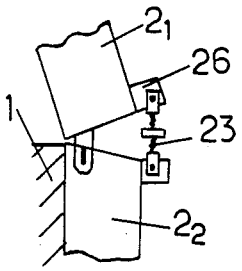
Figure 11B:
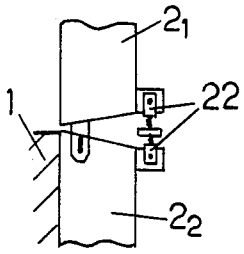
Figure 11C:
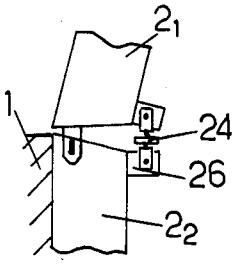
Figure 12A:
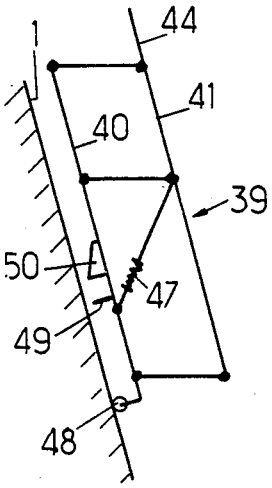
Figure 12B:
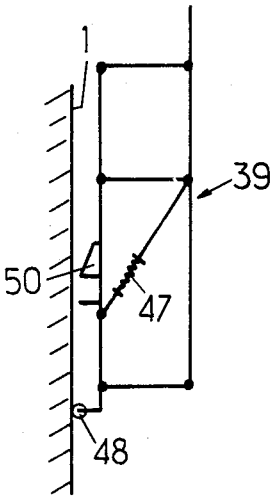
Figure 12C:
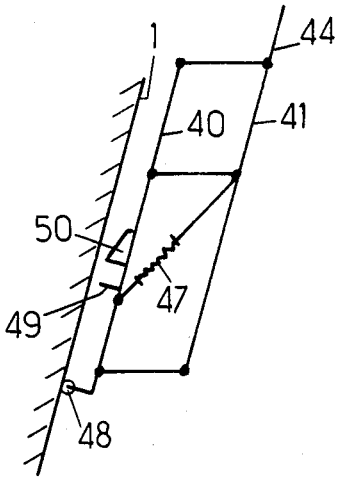
Figure 14:
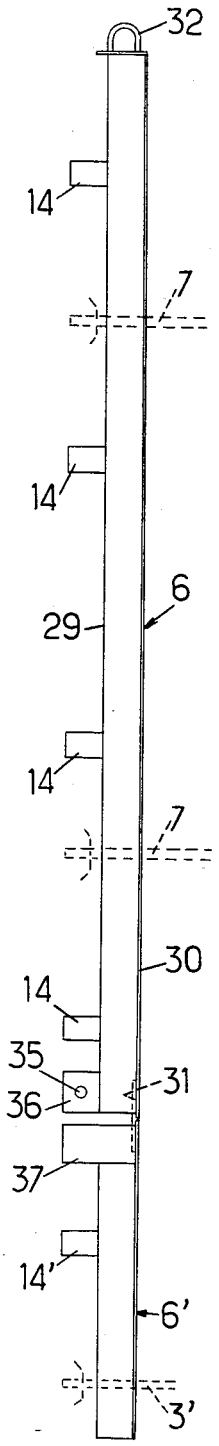
Figure 13:
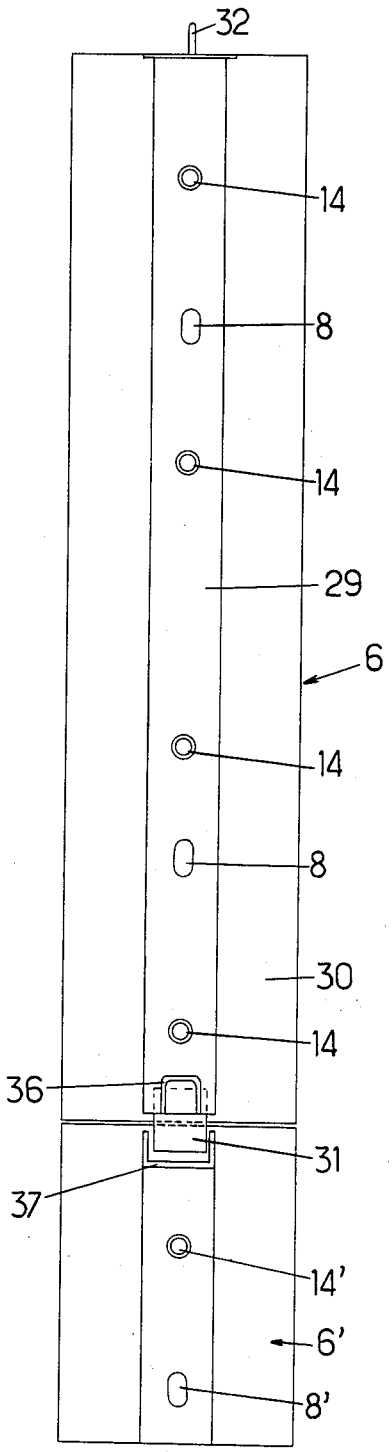
Figure 16:
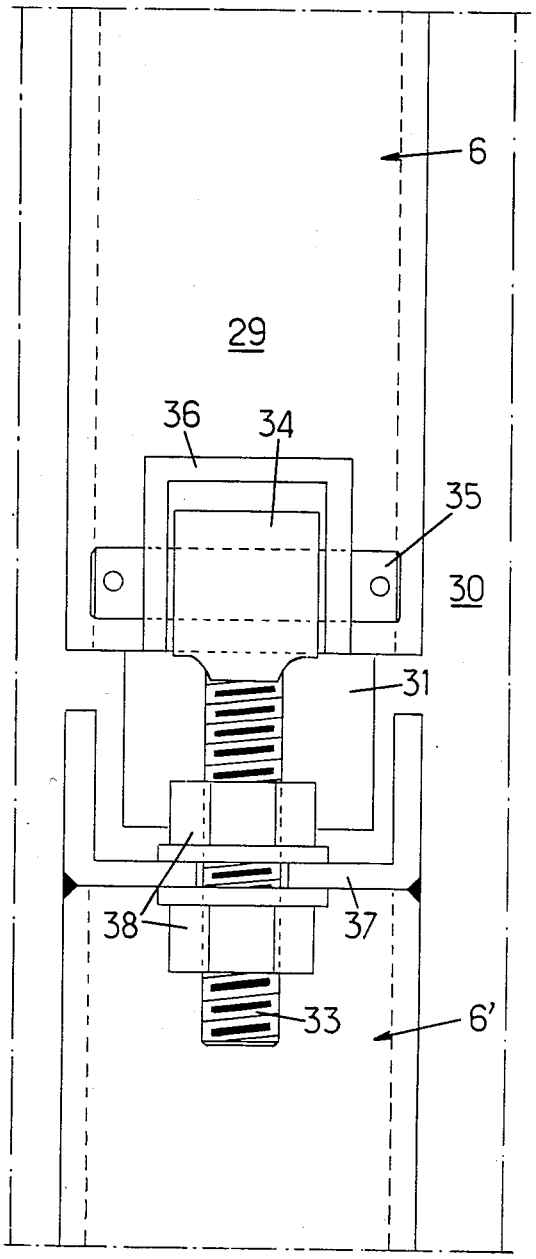
Figure 15:
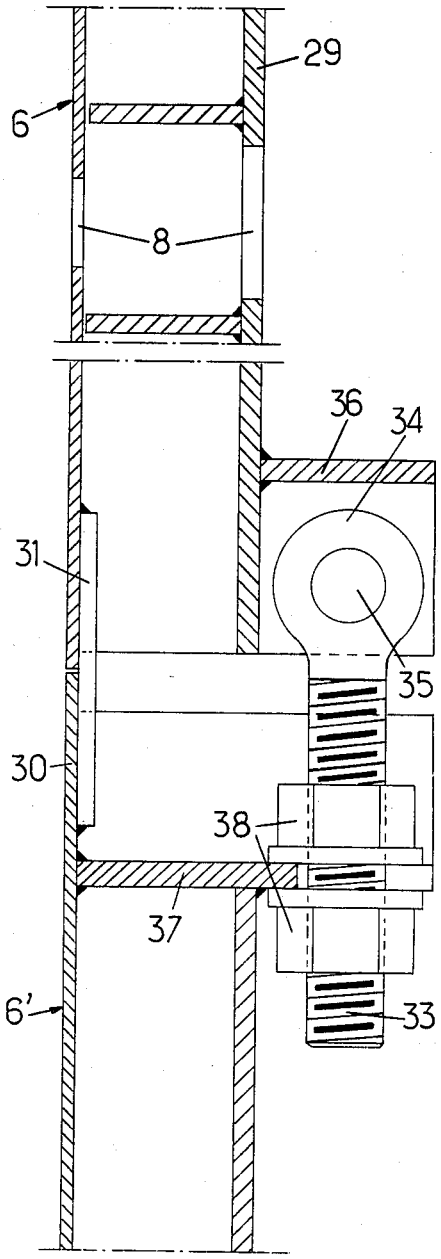
Figure 17:
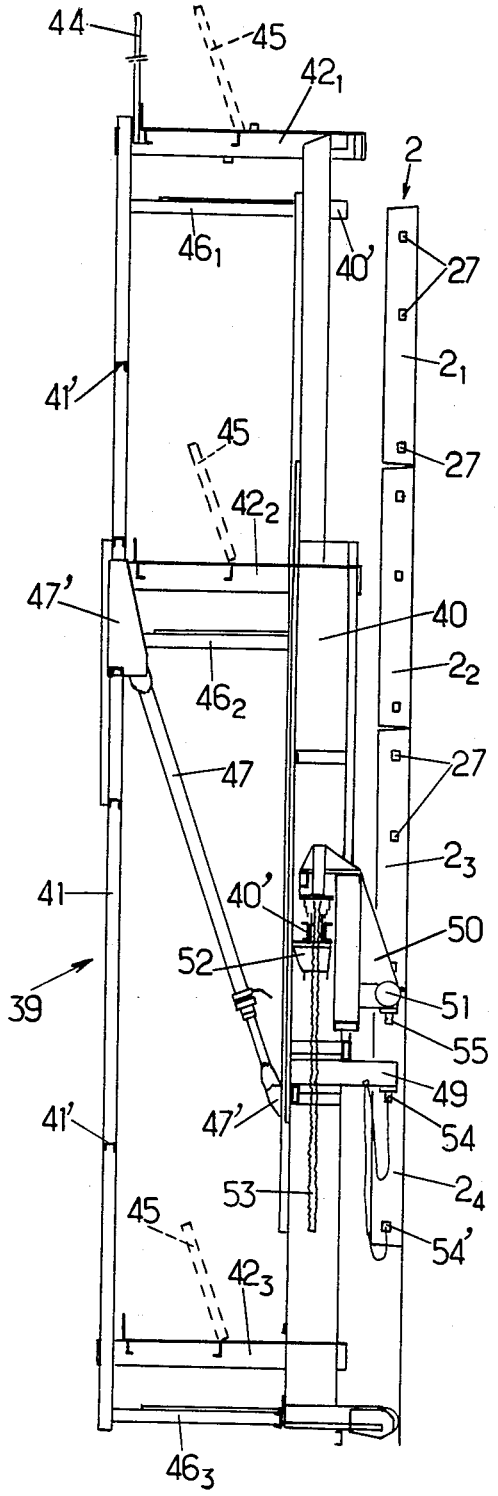
Figure 18:
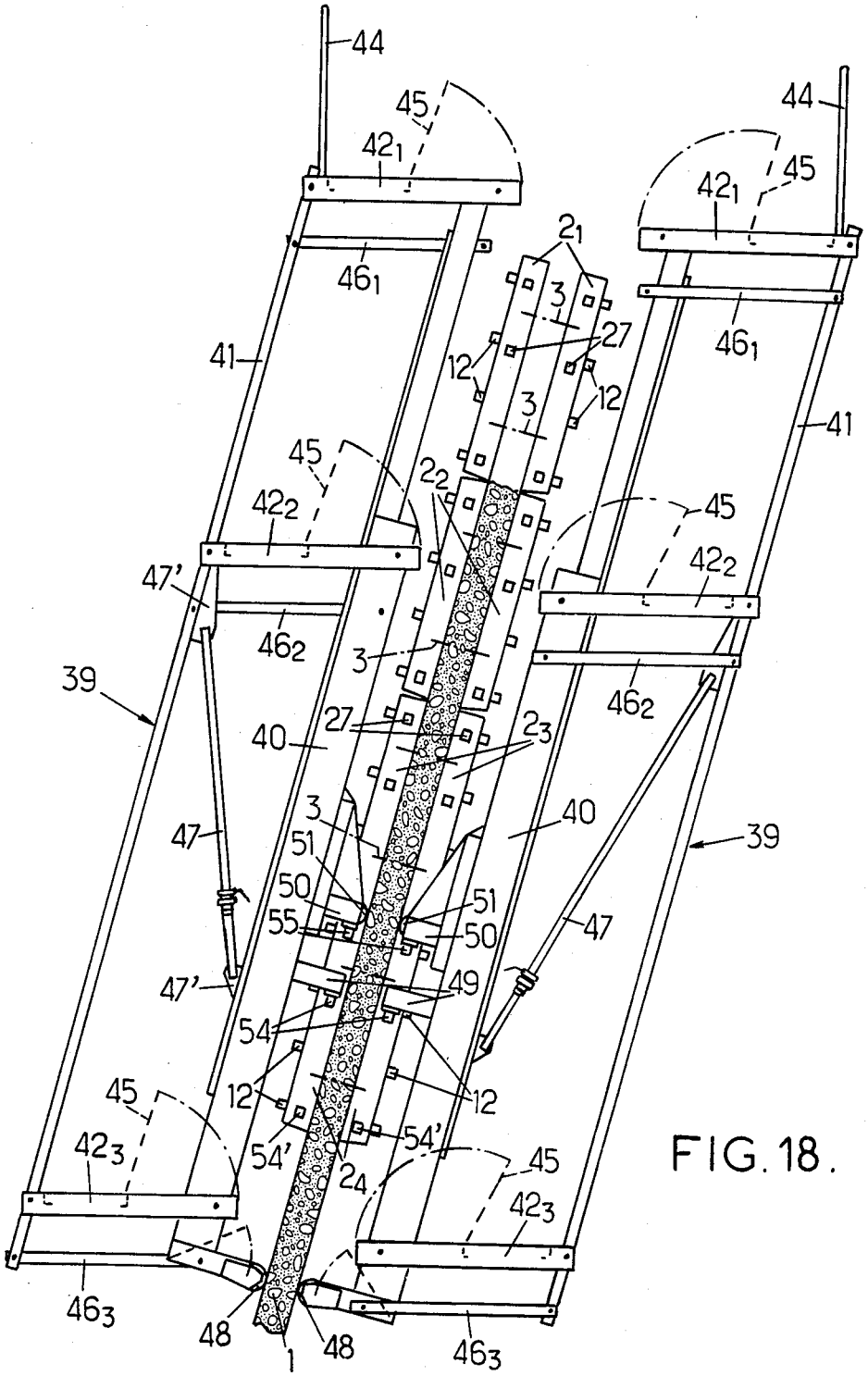
Figure 19:
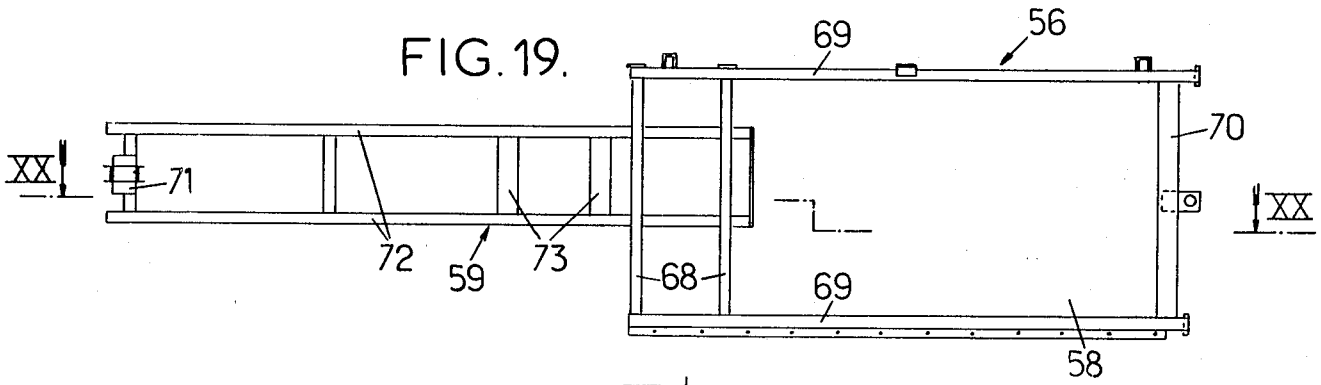
Figure 20:
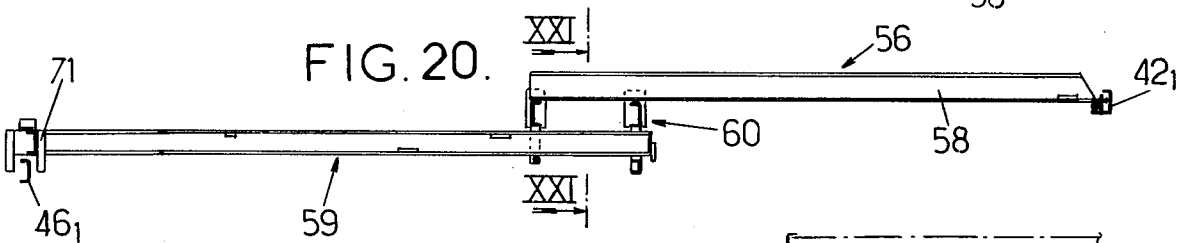
Figure 21:
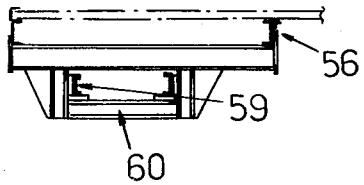
Figure 22:
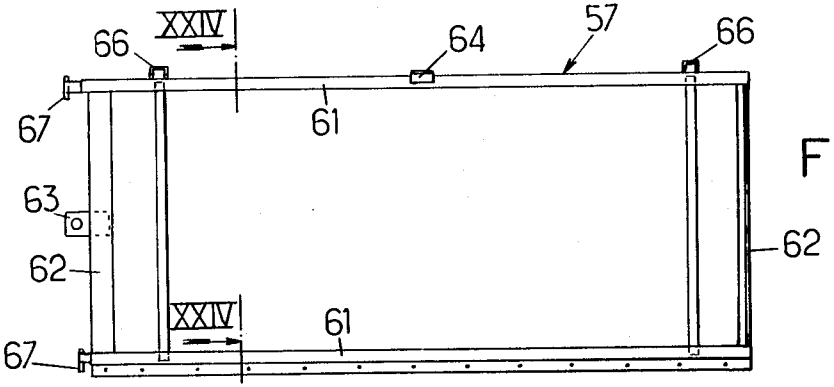
Figure 23:
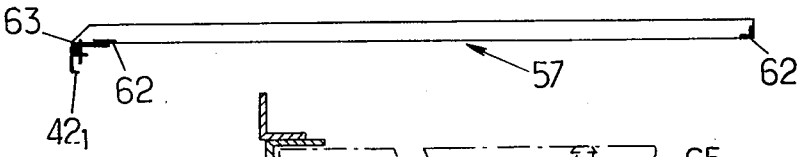
Figure 24:
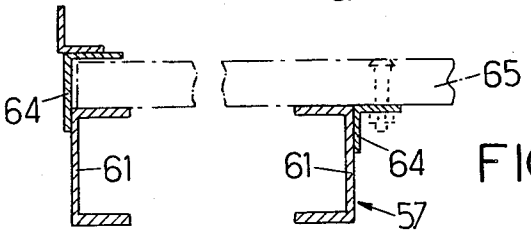

FIGS. 11*a* to 11*c* are, with similar voluntary exaggeration of the slopes, partial and schematic profile biews showing different possible relative slopes between two adjacent main uprights of the same series, depending on the geometry of the part of the wall to be formed (positive slope portion; vertical portion; negative slope portion);

FIGS. 12*a* to 12*c* are, with further voluntary exaggeration of the slopes, schematical profile views showing the shape assumed by the mobile brackets depending on the slope of the part considered of the wall (positive slope; vertical portion; negative slope);

FIG. 13 is a front elevational view of a secondary upright;

FIG. 14 is a profile view of of the secondary upright of FIG. 13;

FIG. 15 is a partial detail view in section showing the hinging of an extension of a secondary upright and the means for adjusting the slope thereof with respect to the upright properly speaking;

FIG. 16 is a front elevational view of the secondary upright of FIG. 15;

FIG. 17 is a simplified view in axial section of a mobile self elevating bracket in the vertical position;

FIG. 18 is a sectional view though the line XVIII—XVIII of FIG. 2 but showing two deformed brackets situated on each side of a sloping portion of the concrete wall, these brackets extending as a whole along two vertical planes, but which are offset laterally with respect to each other;

FIG. 19 is a top view of a lower platform chassis;

FIG. 20 is a sectional view through line XX—XX of FIG. 19;

FIG. 21 is a sectional detail view through line XI—XI of FIG. 20;

FIG. 22 is a top view of an upper platform chassis;

FIG. 23 is a profile view of the chassis of FIG. 22;

FIG. 24 is a detail view in section through line XIV—XIV of FIG. 22; and

FIGS. 25*a* to 25*e* are schematical profile views of a bracket (assumed to be on a vertical portion of the wall), showing the different steps of passing from one lift to the next.

It will be assumed in what follows that the installation of the invention which will be described is used for erecting a cooling or air cooling tower of the type generally used for cooling water in thermal or nuclear power stations.

They are concrete towers of very great height (up to more than a 100 meters for some), formed of an extremely thin self supporting wall, having the general shape of a hyperboloid of revolution, and so with evolutive geometry, not only in so far as the slopes are concerned which may be positive or negative but also in so far as the radii of curvature of the work are concerned which are essentially variable from the base to the top.

An installation in accordance with the present invention will be particularly well adapted to the erection of such towers, either by simultaneous or immediately successive lifts over the whole periphery of the work, or by lifts carried out in blocks.

In the different Figures, the concrete walls being erected is designated by the reference 1.

Figure 1:
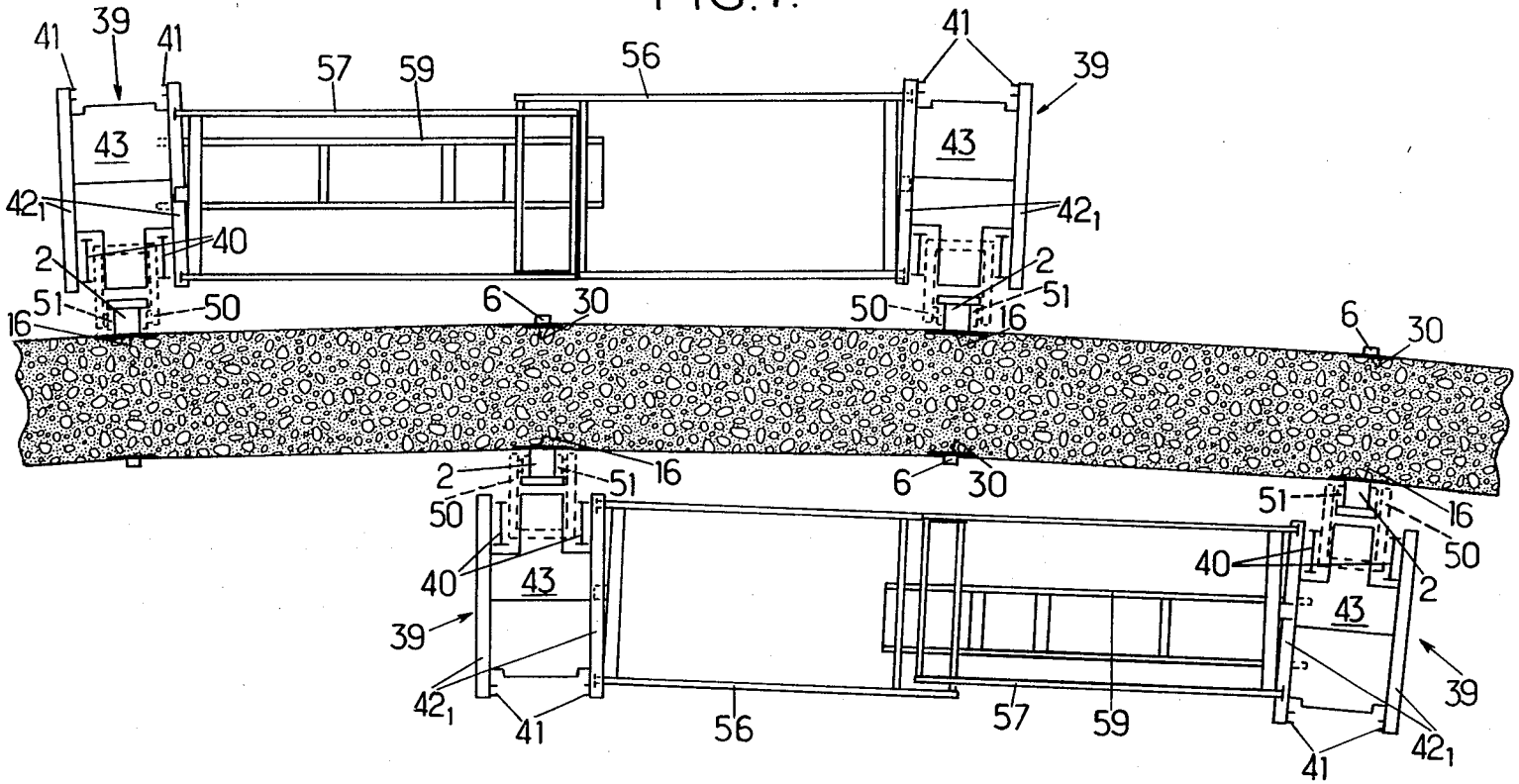
FIG. 1 is a top view of a concrete wall during construction, with on each side of this wall an assembly of two brackets and their platforms, which are in their position of maximum extension.
Figure 3:
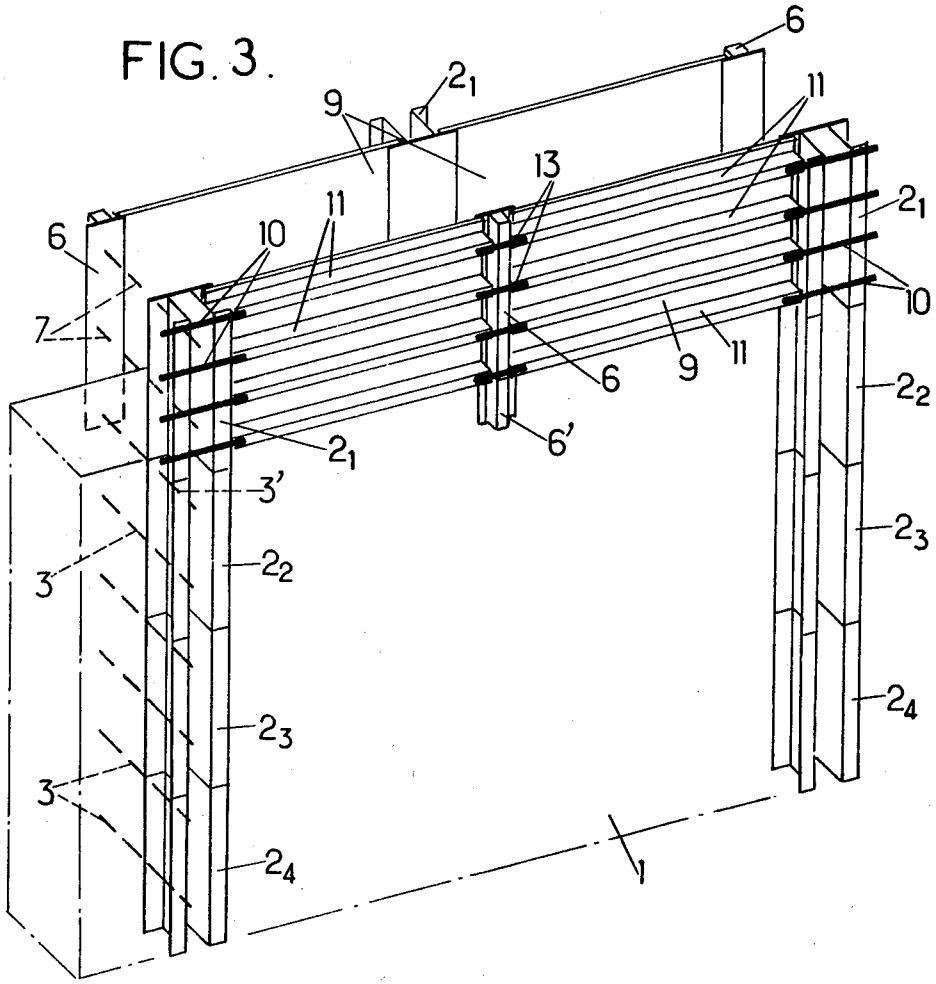
FIG. 3 is a simplified prospective view of a part of the concrete wall during construction, showing the setting up of the series of main uprights, on the one hand, of the secondary uprights, on the other and that of the shutter work.
Figure 4:
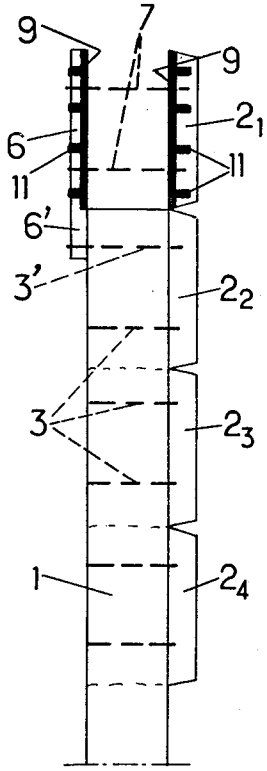
FIG. 4 is a profile view of the wall of FIG. 3, equipped with its uprights and shutter work.

The series of main uprights carrying the overall reference 2 (FIGS. 1 and 2, these uprights being designated respectively, in each series, and from top to bottom, $2_1$, $2_2$, $2_3$, and $2_4$, taking into account that in the presently described example the number of main uprights in each series 2 is four (see particularly FIGS. 3, 4 and 25). The series 2 extend in vertical planes and are evenly spaced apart, generally along the whole periphery of the wall 1, and on each side thereof, their spacing apart which is constant at a given level but essentially variable depending on the height of the level considered being of the order of several meters.

As can be seen in FIGS. 3 and 4, only the three lower uprights $2_2$, $2_3$, and $2_4$ of each series 2 are anchored in the hardened underlying concrete of wall 1, by means of traversing anchorage and securing rods referenced 3, namely two rods 3 per main upright. The holes for passing these securing and anchoring rods therethrough have been referenced at 4 in FIG. 5; they are formed at the level of U shaped reinforcement brackets 5.

In each series 2, the upper main upright $2_1$, serving for shuttering the next lift, is firmly secured to the immediately underlying main upright $2_2$, as well as to a secondary upright 6 which faces it on the other side of wall 1 by means of two fixing rods 7. Each secondary upright 6 is extended downwardly by a hinged extension of the same width 6' by means of which it may be fixed to the underlying portion of hardened concrete 1, by means of another securing and anchoring rod 3', which serves at the same time as upper fixing means for the corresponding main upright $2_2$ (FIG. 4).

The fixing rods 7 and 3', which may be threaded bars, have also been shown in FIG. 14 and the holes (elongate) through which they extend in the secondary upright 6 and its extension 6' have been referenced 8 and 8' in FIG. 13 (see also FIG. 15).

As can be clearly seen in FIGS. 1 to 4 and in accordance with an important arrangement of the present invention, on a given face of the wall, each secondary upright 6 is inserted halfway between two series of adjacent main uprights 2. In other words, and considering what has already been said, this arrangement is further characterized by the fact that said series 2 of main uprights of one face of the wall 1 are offset with respect to the series 2 of main uprights on the other face, by half the distance which on the same face separates two adjacent series, so that each secondary upright 6 on one side of the wall is situated opposite the upper upright $2_1$ of the corresponding series 2 of main uprights situated on the other side of wall 1. That reduces the spacing between two consecutive bearing points of the shutter-work forms without for all that increasing the number of series 2 of main uprights. Furthermore and although with a relatively limited number of series of main uprights, the number of the sides of the superimposed polygons which will form wall 1 may thus be multiplied by 2 and so a circular section may be closely approximated for a lower cost.

The shutter work forms are clearly shown in FIGS. 3 and 4 and have been referenced at 9 (see also FIG. 25). Each form is mounted and fixed between an upper main upright $2_1$ and a secondary upright 6.

At the level of the upper uprights $2_1$ the forms 9 are fixed by means of wedges jammed between bar bolts shown schematically at 10 and cross pieces 11 of the forms. These bar bolts 10 pass through square tubes 12 welded to the outside of the main uprights 2 and shown in FIGS. 5 and 6.

At the level of the secondary upright 6, the forms 9 are fixed by screw bolts shown schematically at 13 and similarly providing the desired fixing between the cross pieces 11 of forms 9 and the secondary upright 6. The fixing nuts of the screw bolts are shown schematically in FIGS. 13 and 14, respectively at 14 for the secondary upright 6 and at 14' for its extension 6'.

Figure 5:
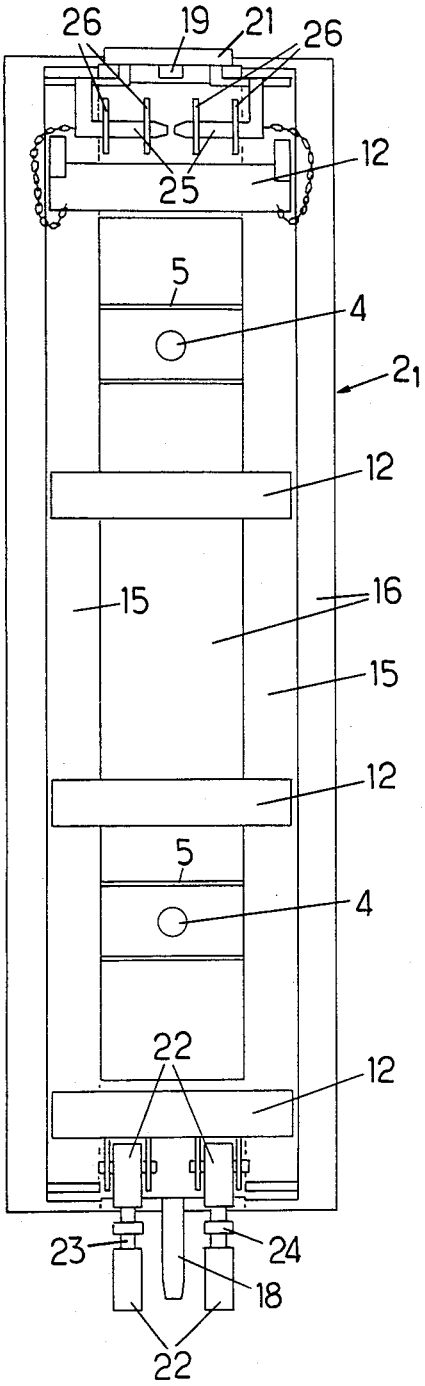
FIG. 5 is an elevational front view of a main upright.
Figure 6:
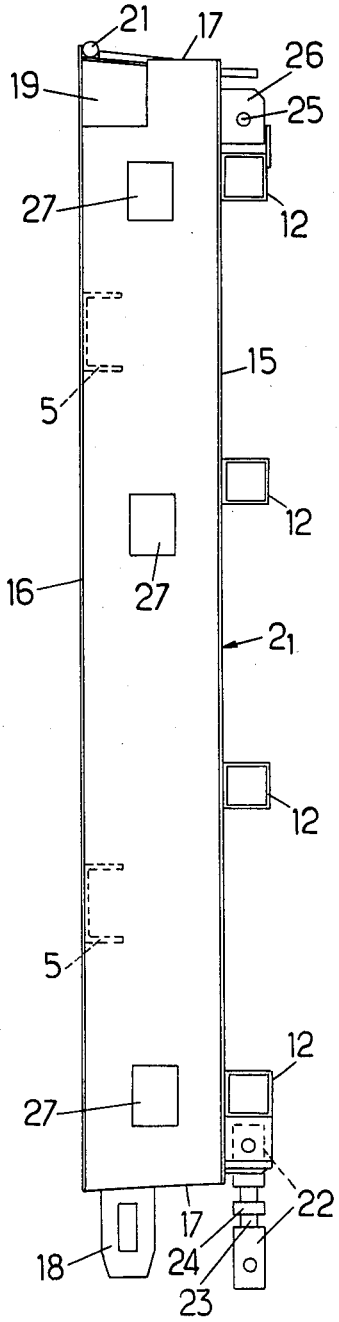
FIG. 6 is a profile view of the main upright of FIG. 5.

As can be seen in FIGS. 5 and 6, each main upright $2_1 \ldots 2_4$ in so far as its structure is concerned, comprises two guide rails 15 made from metal sheet bent into an L, connected transversely together by a wide metal sheet 16, developed over the whole of the height and forming at the same time a compensation surface for the shutter work and resistance caissons. At the top and at the bottom the assembly is closed by two metal sheets 17 bent back in the plane of the guide rails 15 (see also FIGS. 7 and 8).

Each main upright is moreover equipped, at its upper end and at its lower end, with coupling means for connecting it to an adjacent main upright, as already mentioned above, as well as appropriate adjustment means for accurately adjusting the slope of the upper main upright with respect to that of the immediately underlying main upright. It will be readily understood that the coupling means provided at both ends of a main upright are complementary; they are shown then as a whole on a single upright, particularly in FIGS. 5 to 8.

Figure 9:
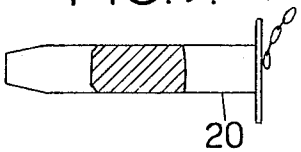
FIG. 9 is a top view of the key.

These means comprise, at the lower part of each upright, a pin 18 adapted to engage in an upper opening 19 of the cooperating main upright and to be locked therein by means of a key 20 whose shape in section can be seen in FIG. 9. This key may be locked between the bottom of the eye of pin 18 and the upper bent back metal sheet 17, when the adjustment of the relative spacing between the two uprights has been performed. These uprights may in fact pivot with respect to each other about a round bar 21 serving as transverse hinge shaft which allows adjustment of the radial slope of the main upper upright, of course at the desired moment, in each of the series 2 of uprights.

The first spacing adjustment device comprises for this purpose, at one end of the upright, two pairs of gusset plates 22, each pair receiving the two ends of a screw 23 with spacing adjustment nut 24, the two gusset plates 22 associated with an upright are hingedly connected thereto by means of removable pins 25, each mounted in a fixed clevis 26.

With this device, the ends of two main uprights may be rapidly separated and joined together again when it is required to cause a lower main upright to pass above the other three, and it also allows the upper main upright which has just been placed in position to be conveniently and rapidly adjusted in the radial direction.

Figure 7:
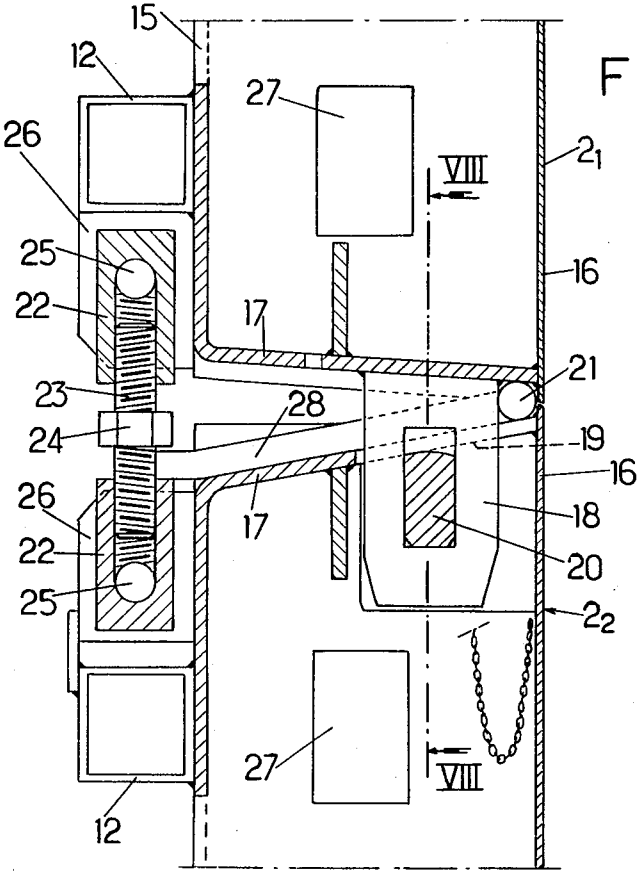
FIG. 7 is a partial detailed view, in section perpendicular to the hinged access, of the means for adjusting the relative slope of two adjacent main uprights.
Figure 8:
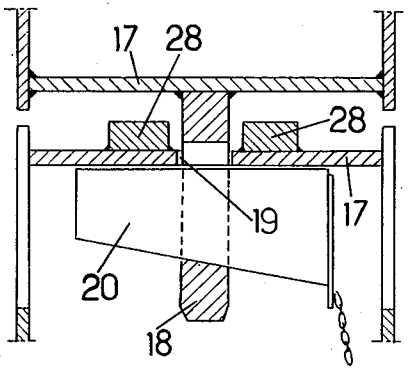
FIG.8 is a partial view in section through line VIII—VIII of FIG. 7.

Finally, there are further shown at 27 in FIGS. 5 to 7 holes (three per main upright) for passing pins therethrough for supporting the brackets and at 28 flat bars for reinforcing the caisson structure of the uprights.

As for the secondary uprights 6, which may be recovered at each lift and whose purpose is essentially to contribute to the form work, without an essential strengthening function, and which are adjustable only in the radial plane, they are formed by a channel bar shown at 29, welded flat on a wide bottom metal sheet 30, which allows a certain tangential compensation of the shuttering panels to be obtained, which have a height which may for example be of the order of 1.50 m.

This contribution of the metal sheet 30 of these secondary uprights 6 to the shutter work, concurrently with the forms 9, allows, like that of the bottom metal sheet 16 of the main uprights, shuttering to be available which is always sufficient even for wide variations of the geometry of the wall, without requiring constant adjustment of the dimensions of the forms, which avoids losses of material and the sawing operations which would be otherwise indispensable, as is the case in known techniques.

As was mentioned above, each secondary upright 6 is provided at its lower end with an extension 6' for securing it to the solid concrete of the underlying casting, for possibly compensating the shutter work and finally for allowing ready adjustment of the slope of the upright 6 concerned with respect to said casting.

This extension 6' has a shape similar to that of upright 6 and is pivotably connected thereto by a simple metal sheet $13_1$ welded to the inside of the bottom metal sheet 30. At its upper part, each secondary upright 6 is provided with a lifting ring 32 and, at its lower part, with a second spacing adjustment device, comprising a screw 33. This screw is held in position by a head ring 34 and a pin 35 passing through a clevis 36 of the secondary upright 6 and engages in a hole of a transverse metal sheet 37 of the extension 6'. Two nuts 38 engaged on screw 33 clamp the metal sheet 37 and thus allow the relative spacing between uprights 6 and its extension 6' to be readily adjusted.

By way of indication, it may be noted that for a height of 1.5 m of the secondary upright 6 the extension 6' may have a height of the order of 0.45 m.

In FIGS. 1 and 2, the brackets have been shown generally at 39; they are also described in detail in FIGS. 17 and 18. They are each constructed in the form of hinged parallelogram structures, which are formed from two main front stringers 40 connected hingedly by bearing cross pieces to secondary rear stringers 41. The main stringers 40 are connected together by rigid cross pieces 40' and the secondary stringers 41 by wind bracers 41' so as to form a rigid working cage which can only be deformed in the radial plane, as a function of the slope of wall 1 and adjustably.

As for the above mentioned bearing cross pieces they comprise three pairs of first cross pieces $42_1$, $42_2$ and $42_3$ situated on the opposite sides of each bracket 39 and respectively at the level of three indeformable landings 43 made from metal sheet welded to trimmer beams, equipped with parapets 44, these landings provide passage at three different levels through each bracket 39, for passing from one platform to the next (see also FIGS. 1 and 2). These landings 43 are moreover each equipped with a trap door 45 for passing equipment therethrough, and more especially the main uprights $2_1$ . . . $2_4$ for the lower level (lever 3) to the upper level (level 1).

Said bearing cross pieces further comprise three second cross pieces $46_1$, $46_2$, $46_3$ disposed on one side of each bracket, also hinged to the stringers 40 and 41 and situated at a level lower than that of the preceding ones. These cross pieces serve as supports for the platform pins which will be described hereafter, the platforms bearing on one side on these second cross pieces and on three of the first cross pieces and on the other side on the other three first cross pieces.

Between each main stringer 40 and the secondary stringer 41 which faces it, in each bracket 39, there further extends a screw adjusting stay or strut 47 for deforming appropriately the hinged parallelograms forming the structure of the brackets, as can be seen by comparing FIGS. 17 and 18, so that they are always parallel to the concrete wall 1 while maintaining the horizontality of the platforms at each of their three levels. These screw stays 47 are hinged in gusset plates 47′ of the main and secondary stringers.

At 48 there is further shown an additional roller bearing device or similar 48, which is disposed at the lower end of each bracket 39 and bears on wall 1 while transmitting directly thereto the normal compression forces.

Each bracket 39 comprises finally two members essential to its operation, and more especially to its self-elevating function, namely a fixed arm 49 mounted between the two main stringers 40 and a mobile arm 50, also shown in FIGS. 1 and 2 and capable of moving along these stringers, above the fixed arm 49. It is through this mobile arm 50 that each bracket 39 is guided along the corresponding series 2 of main uprights, the mobile arm being for this purpose provided with two rollers 51 bearing behind the flanges of the main uprights, which flanges consequently receive the normal forces of the mobile arm, other rollers guiding it between the main stringers 40 of the bracket.

The mobile arm 50 is moved by a motor 52 bolted to a cross piece 40′ connecting together the two main stringers 40 and rotating a screw 53 axially fixed to the mobile arm.

Motor 52 may rotate in both directions so that the relative movement between the mobile arm 50 and bracket 39 may take place in one direction or in the other, for a purpose which will be described here below.

It should be noted that with the same end in view the fixed arm 49 may bear on a main upright through a pin 54 (see also FIGS. 17 and 18), engaged in two through holes 27 in the upright considered, an additional pin 54 engaged in the two immediately lowered through holes providing the security. Said pin 54 receives the tangential forces from the fixed arm 49.

Similarly, the mobile arm 50 may bear on a main upright through a pin 55 engaged in two other through holes 27 (above the preceding ones) in the upright considered.

The structure of the platforms is shown in FIGS. 19 to 24 but can also be seen in FIGS. 1 and 2. Each platform comprises a lower platform chassis 56 (FIGS. 19 to 21) and an upper platform chassis 57 (FIGS. 22 to 24).

The lower chassis 56 is formed by a frame 48 bearing on a bracket cross-piece $42_1$ (or $42_2$ or $42_3$), and a pin 59 whose end bears on a cross-piece $46_1$ (or $46_2$ or $46_3$) of the adjacent bracket, this latter cross-piece being at a level slightly lower than that of the first one. This pin 59 is mounted for sliding by its other end in a cradle 60 fixed under the end of frame 58 which is opposite the end bearing on cross-piece $42_1$. Any variation in the spacing between supports $42_1$ and $46_1$, i.e. any variation of the radius of curvature of wall 1, will then result in pin 59 sliding with respect to the frame 58 of the lower chassis structure 56.

The upper platform chassis 57 is formed from a frame bearing, on the one hand, on a bracket cross piece $42_1$ (the one situated above the above mentioned cross piece $46_1$) and, on the other hand, and also slidingly, on the lower chassis 56.

Thus the length of the platform may be very conveniently and automatically obtained tangentially between two adjacent brackets 39, without any loss of material and without any complicated mechanism, as can be readily seen from comparing FIGS. 1 and 2 (maximum spacing apart in FIG. 1 and minimum in FIG. 2).

The construction of the upper and lower platform chassis may be as follows.

The upper chassis 57 is formed from two shafts 61 connected together by metal cross pieces 62.

The bearing cross piece $42_1$ is provided with a gusset plate having a fixing hole 63 along the anchoring access to bracket 39, allowing rotation thereof in a horizontal plane. The ends of shafts 61 bearing on bracket 39 are provided with two transversely disposed round portions 67 for rotation in the vertical plane and slight sliding in the horizontal plane.

Along these shafts 61 are fixed fittings 64–66 for fixing the planking 65 and a removable parapet (not shown).

The frame 58 of the lower chassis 56 is constructed identically to the upper chassis.

Cradle 60 is formed by two cross pieces 68 connected to the shafts 69. A cross piece 70 forms the support under compression (at the end). The other is associated with a cradle 71 supporting beam 59 under traction. The assembly forms a sliding housing 71-$46_1$.

The "beam 59-cross piece $46_1$" contact points are provided with sliding teflon bearing portions. Beam 59 is formed from two longitudinal elements 72 connected together by transverse stiffeners 73.

At the end of the bearing points of beam 59 on bracket 39 is provided an anchorage key fixing the beam to this bracket in free vertical rotation.

Figure 10:
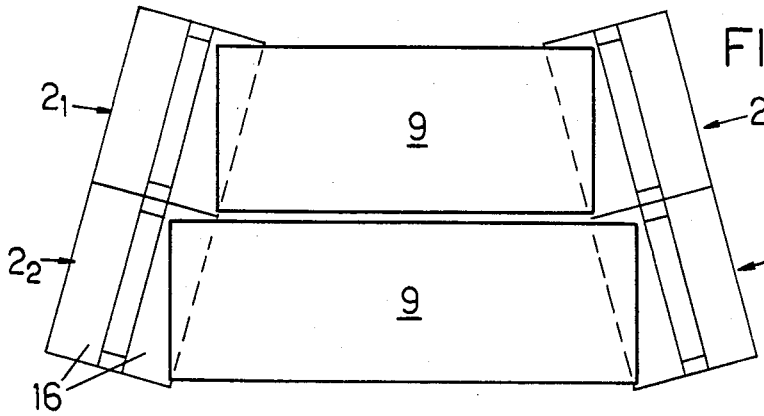
FIG. 10 is a schematical elevational view with, for the sake of clarity, an exaggeration of the slopes of the main uprights and of their widths, showing the participation of the uprights in shuttering the walls.

FIG. 10 shows schematically the possibility of a certain tangential compensation of the form work by the flanges of the main upright 2, which has already been mentioned above.

FIGS. 11*a* to 11*c* also show schematically three different relative positions of slope between two successive main uprights and FIGS. 12*a* to 12*c* also show schematically three different slope positions of the mobile brackets 39, which may thus be always parallel to the wall 1 with the platforms remaining horizontal.

Figures 25A, 25B, 25C, 25D, 25E:
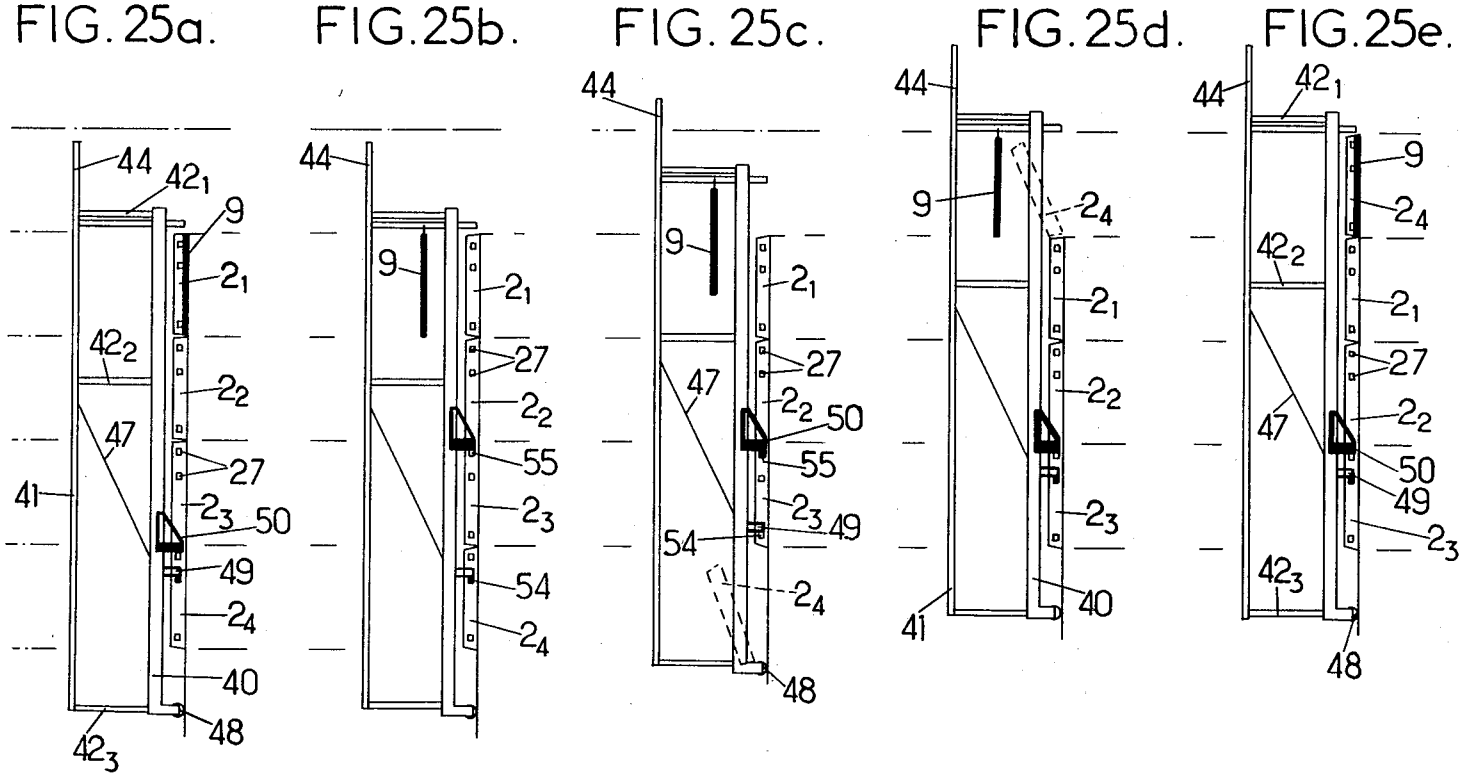

The operations for self elevation of brackets 39 take place in the following way, from a starting position such as the one shown schematically in FIG. 25*a*: the motor 52 is set in rotation in a direction such that, through its groove 53, it causes the mobile arm 50 to rise as far as the position shown in FIG. 25*b*. Pin 55 is withdrawn from its first position in upright $2_4$ for engagement in the through holes 27 in upright $2_3$, under the bracket 50; with the upper lift hardened, the forms 9 are withdrawn, on each side of wall 1).

The motor 52 is then caused to rotate in the opposite direction, which causes bracket 39 to rise which bears on the main upright $2_3$ through the mobile arm 50. This rise is stopped when it reaches 0.75 m, the fixed arm 49 being then located at a level such that, through a pin 54, it may be held in position bearing on the lower through hole 27 of upright $2_3$ (FIG. 25*c*). The lower main upright $2_4$ may then be separated from wall 1 and lifted by transfer means (hoists or similar), through trap doors 45 in landings 43, to the upper level of the bracket, where it may then be positioned for carrying out a new lift.

Then motor 52 is caused to rotate in the same direction as previously so as to cause bracket 39 to rise again over 0.75 m and to bring it into a position (FIG. 2*d*) in which the fixed arm 49 may be clamped on the through holes 27 of upright $2_3$, situated immediately below those which lock the mobile arm 50.

By thus raising the mobile arm 39 over 1.50 m, but in two steps, slopes of the platforms which are too great may be avoided if the raising of two adjacent mobile brackets is not simultaneous.

The form 9 may then be repositioned and fixed, as was described, to the upper uprights, as well as to the secondary upright 6. Then we have the position shown in FIG. 25*e* identical to that shown in FIG. 25*a*, but 1.50 meters higher.

As is evident and as it follows moreover already from what has gone before, the invention is in no wise limited to those of its modes of applications and embodiments which have been more particularly considered; it embraces, on the contrary, all variations thereof.

I claim:

1. Self elevating form work installation with variable geometry for making concrete surfaces or walls, particularly very high concrete walls, these walls being formed by successive lifts or constant height over the whole length of the work until the desired height is obtained, this installation comprising essentially means for temporarily fixing working platforms on an underlying part of the wall which has already been cast and hardened, means for shuttering the next lift over said under lying part, and elevating means adapted to produce self elevation of the whole of the platforms, which installation is characterized in that said fixing means comprise series (2) of main uprights extending substantially in vertical planes, these series being evenly spaced apart along the length of the wall, said main uprights ($2_1 \ldots 2_4$) serving essentially, on the one hand, as elements for maintaining the shuttering forms in position and, on the other hand, as means for guiding and securing self elevating mobile brackets supporting said platforms and transfer means having pivot means on one side and elevation adjustment means on an opposite side of at least one of said uprights.

2. Installation according to claim 1, characterized in that, in each series of main uprights, all the uprights except the upper upright ($2_1$) are anchored in the cast and hardened concrete of a number of the preceding lifts.

3. Installation according to claim 1, characterized in that each series (2) of main uprights comprises a number of uprights ($2_1 \ldots 2_4$) situated in the same substantially vertical plane, superimposed directly, hinged to one another and each of which is sloped to a given angle with respect to the adjacent upright.

4. Installation according to claim 2, further comprising a transfer means adapted to be actuated after casting and to transfer the lower main upright ($2_4$) of each of said series of uprights to position situated above the upper main upright ($2_1$) of the series considered, in which position said transferred upright ($2_4$) may then be fixed with the desired slope with respect to the immediately underlying main upright ($2_1$), by using appropriate adjustment means.

5. Installation according to claim 2, characterized in that, in each of said series (2) of main uprights, the number of uprights is four, each series of uprights being then anchored in the cast and set concrete of the three preceding lifts.

6. The installation according to claim 4, characterized in that said appropriate adjustment means comprise, on the one hand, at both ends of said main uprights, a first screw spacing adjustment device (23), opposite a transverse hinge means (21) and, on the other hand a keying system (18, 20), adapted to clamp two main adjacent uprights with relative slope.

7. Installation according to claim 1, characterized in that said shuttering means comprise, in cooperation with the upper uprights ($2_1$) of said series of main uprights, secondary uprights (6) inserted on each side of wall (1) between two series of adjacent main uprights.

8. Installation according to claim 7, characterized in that, on a given face of the wall, each secondary upright (6) is inserted halfway between two series (2) of adjacent main uprights.

9. Installation according to claim 8, characterized in that said series of main uprights (2) of one face of the wall are offset, with respect to the series of main uprights (2) of the other face, by half the distance which, on the same face, separates two adjacent series (2) so that each secondary upright (6) on the one side of the wall (1) is located opposite the upper upright ($2_1$) of the corresponding series of main uprights situated on the other side of the wall.

10. Installation according to claim 9, characterized in that each secondary upright (6) is fixed to the upper main upright ($2_1$), which is facing it by means of an assembly of fixing rods (7) traversing the space provided for the next casting.

11. Installation according to claim 7, characterized in that, with said secondary uprights (6) being recoverable at each lift, each of them is extended at its lower end by a hinged extension (6'), whose slope with respect to the secondary upright properly speaking is adjustable.

12. Installation according to claim 11, characterized in that the hinging of the secondary upright (6) to its extension (6') is provided by a simple bendable metal sheet (31), and in that the adjustment of their relative slope may be provided by means of a second screw spacing adjustment device (33) or similar, opposite said hinge.

13. Installation according to claim 1, characterized in that said self elevating mobile bracket (39) supporting said platforms (56, 57) and which may be guided and secured on said main uprights, are constructed in the form of hinged parallelogram structures, these structures being associated with means (47) for adjusting their deformation, actuatable as a function of the slope of the wall portion (1) to be shuttered, these means being adapted to maintain said platforms constantly horizontal.

14. Installation according to claim 13, characterized in that each bracket (39) comprises main front stringers (40) hingedly connected, by means of bearing cross pieces (42, 46), to secondary rear stringers (41), said deformation adjustment means being formed by screw adjustment stays (47) or similar extending diagonally between main (40) and secondary (41) stringers.

15. Installation according to claim 14, characterized in that said bearing cross pieces (42, 46) comprise on the one hand first cross pieces (42), at the level of landings (43) substantially indeformable, these landings providing passage from one platform to the adjacent platform at the same level and secondary cross pieces (46) supporting the platforms (56, 57) respectively at the same levels as said landings, but disposed below the preceding ones.

16. Installation according to claim 15, characterized in that each bracket (39) comprises three landings (43), two adjacent brackets consequently supporting three levels of platforms.

17. Installation according to claim 15 characterized in that in each of said landings (43) is provided with a trap door (45) for passing from one level to the adjacent level.

18. Installation according to claim 13 characterized in that each bracket (39) comprises on the one hand a fixed arm (49), disposed between the main stringers (40) and adapted to bear on the corresponding main uprights (2) and, on the other hand, a motor driven mobile arm (50), adapted to be guided on the one hand between the main stringers (40) of the bracket and on the other hand on said corresponding main upright (2) and also to bear on said main upright at a given location.

19. Installation according to any one of claims 13 to 17, characterized in that each bracket (39) comprises an additional bearing device—with roller (48) or similar—which is disposed at its lower part, so as to be able to come to bear directly on the wall (1).

20. Installation according to claim 1, characterized in that each platform (56, 57) comprises a lower platform chassis (56) and an upper platform chassis (57) extending between and bearing on two adjacent brackets (39), these two chassis being free to slide with respect to each other.

21. Installation according to claim 20, characterized in that said lower platform chassis is formed from a frame (58) bearing on one bracket and a beam (59) bearing on the adjacent bracket, said beam being slidingly connected to said frame and in that said upper platform chassis (57) is mounted for bearing on the one hand on the same brackets 39 as said beam (59) and on the other hand also slidingly on the lower platform (56).

* * * * *

UNITED STATES PATENT AND TRADEMARK OFFICE

CERTIFICATE OF CORRECTION

PATENT NO. : 4,540,150

DATED : September 10, 1985

INVENTOR(S) : TZINCOCA, Alexandre

It is certified that error appears in the above—identified patent and that said Letters Patent is hereby corrected as shown below:

Please correct the "Foreign Application Priority Data" to read as follows:

November 9, 1982 France
82 18785

Signed and Sealed this

Twenty-first Day of October, 1986

[SEAL]

*Attest:*

DONALD J. QUIGG

*Attesting Officer*

*Commissioner of Patents and Trademarks*